United States Patent [19]

Gach

[11] 3,963,139

[45] June 15, 1976

[54] TAMPER-INDICATING CLOSURE COMBINATION

[75] Inventor: Peter Paul Gach, Evansville, Ind.

[73] Assignee: Sunbeam Plastics Corporation, Evansville, Ind.

[22] Filed: Aug. 22, 1975

[21] Appl. No.: 606,889

[52] U.S. Cl. ..... 215/216; 215/217; 215/295; 215/305; 215/365

[51] Int. Cl.[2] ..... B65D 55/02; B65D 85/56; A61J 1/00

[58] Field of Search ..... 215/7, 9, 216, 217, 215/218, 295, 305, 252, 253

[56] References Cited

UNITED STATES PATENTS

| | | | |
|---|---|---|---|
| 3,820,678 | 6/1974 | Zipper et al. | 215/305 X |
| 3,888,376 | 6/1975 | Cooke | 215/217 |
| 3,902,621 | 9/1975 | Hidding | 215/216 X |

*Primary Examiner*—George T. Hall
*Attorney, Agent, or Firm*—Henry K. Leonard

[57] ABSTRACT

A tamper-indicating closure combination consisting of a container having a circular neck and a twist-on cap therefor. The container neck has external interrupted thread sections with ratchet teeth on their under surfaces. The cap has similar, cooperating internal thread sections on the inner surface of its skirt with ratchet teeth on their upper surfaces. When the cap is turned onto the neck, the sets of ratchet teeth interengage and lock the cap against retrograde rotation. The cap also has a puller which is connected to the cap, a first section thereof being connected by frangible portions and a second section thereof being connected permanently to said cap. In order to remove the cap, the puller is broken away at the first section and then is pulled upwardly and outwardly relative to the container neck to disengage the cooperating sets of ratchet teeth. The cap is replaced by turning it onto the bottle neck for re-engaging the cooperating threads and ratchet teeth. The fact that one end of the puller is disconnected indicates that the container has been opened. The closure combination also can be so proportioned that the force necessary, first to break the frangible connections between the puller and the cap and, afterwards, to pull the cap up and away to disengage the cooperating ratchet teeth in order to remove the cap, results in the closure combination also being child-resistant.

14 Claims, 6 Drawing Figures

TAMPER-INDICATING CLOSURE COMBINATION

BACKGROUND OF THE INVENTION

In recent years the development of caps for closing containers has proceeded rapidly in two different areas and objectives. Usually, these objectives are mutually exclusive. First, many caps have been suggested which are denominated as "childproof" or, more properly, "child-resistant" and many of such caps have been extremely complicated to close or to open, expensive to manufacture because they consist of more than one unitary part and unsatisfactory in use because many of them are so resistant to opening that it is difficult even for an older child or an adult to open them. Some have been so designed that replacement is also difficult. Secondly, many caps have been designed which are denominated "tamper-proof", the objective being to provide a cap for the container which will immediately indicate whether or not the container previously has been opened. Many of these caps also are expensive, difficult to open initially and, in many instances, impossible to restore for recapping the container.

Problems of this type have been particularly acute in wide mouth containers such as those in which relatively large quantities of foods are supplied to institutions or to commercial establishments. In such places, the content of the container frequently is not emptied at once but partially emptied from time to time over a several day period so that it is necessary that the container can be reclosed after having been opened. It is also important that, if possible, it be immediately apparent to someone examining the container whether or not it previously has been opened.

To a considerable extent, the attempts to devise tamperproof closures for containers also have resulted from the fact that in large supermarkets the activities of the shoppers cannot be supervised and some persons have the habit of removing the lid or cap from a container of an expensive product and substituting for it a cap of a less expensive product so that when the expensive product goes to the check-out counter, the clerk charges the customer for the less expensive product but the customer obtains the more expensive product. If a tamper-proof cap is placed upon such a product, the clerk can quite readily perceive that the cap has been removed and that the customer is attempting a fraud.

While most child-resistant closures have been designed for the purpose of closing containers of dangerous substances, it also would be desirable if containers of nonharmful products were provided with child-resistant closures. Even such a simple product as dill pickles or catsup could become harmful to a small child if that child were able to open the container and consume, say, a quart or a gallon. At least, in many cases, a small child opening such a container will spill the contents on itself or on its surroundings and the prevention of this type of activity also is desirable.

It is, therefore, the principal object of the instant invention to provide a tamper-indicating closure combination wherein the cap and the neck of the container have cooperating means by which the cap is permanently positioned on the container in closed position and cannot be removed without actuating a member which immediately reveals that the cap has been removed. In addition, a cap embodying the invention readily can be initially placed on a container having a proper neck configuration at a factory which fills the container and readily can be restored to closed position on the container by an older child or adult who has opened the container.

It is yet another object of the instant invention to provide a closure combination comprising a unitary cap and a cooperating neck finish on a container which initially is tamperproof and which continues to be child-resistant no matter how many times it has been opened and reclosed.

Yet another object of the instant invention is to provide a child-resistant closure comprising a unitary cap and a cooperating neck finish on the container which automatically compensates for compression of the cap liner which may occur after the cap has been removed and replaced a number of times.

DESCRIPTION OF PREFERRED EMBODIMENT

Figure 1:
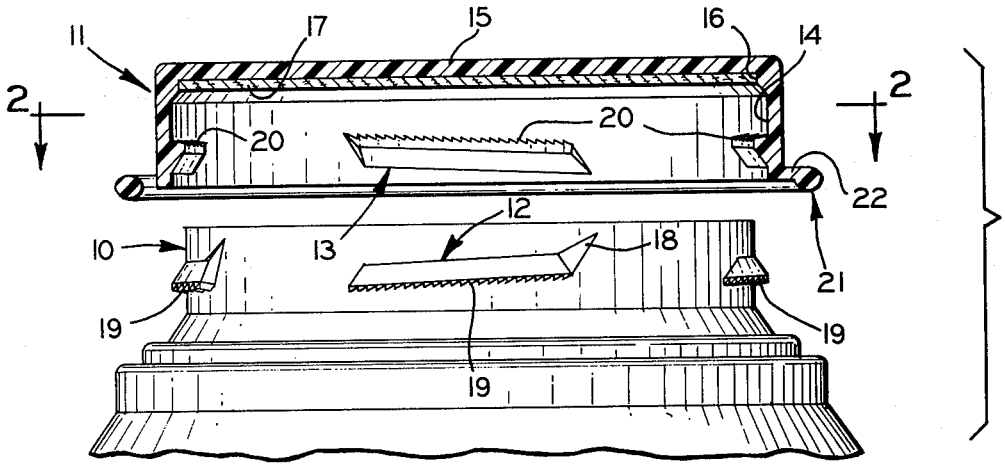
FIG. 1 is a fragmentary exploded view showing a container neck in side elevation and a cooperating cap according to the invention in transverse vertical section.

A closure combination embodying the invention comprises a special container neck 10 and a cooperating twist-on cap 11. The container neck 10 and cap 11 have cooperating threads by which the cap is retained on the container neck 10. In this preferred embodiment, the cooperating threads on the neck 10 and cap 11 consist of interrupted thread sections 12 and 13 respectively. In the illustrated embodiment, there are four thread sections 12 spaced around the periphery of the container neck 10 and four similar, though inverted, thread sections 13 spaced around the interior of a cap skirt 14. The cap 11 also comprises a flat disc-like top 15 and a suitable recess 16 for retaining a disclike liner 17.

While four cap thread sections 13 and four neck thread sections 12 are shown in the drawings, it will be appreciated that the particular number of thread sections 12 or 13 does not constitute the critical factor of the instant invention and, indeed, while interrupted thread sections 12 and 13 are shown, they could be continuous both on the container neck 10 and the cap skirt 14 if desired. If the thread sections are interrupted or discontinuous as illustrated, however, then it is necessary that the thread sections 12 on the neck 10 be spaced circumferentially from each other a distance sufficient to allow clearance therebetween of the thread sections 13 on the interior of the cap skirt 14.

Where such pairs of thread sections 12 and 13 are employed, the circumferential extent of such section 12 or 13 must be less than 360° divided by $2x$ in which X is the number of individual interrupted thread sections on each of the neck 10 and cap skirt 14 in order to provide the clearance necessary for the cap 11 to be placed downwardly on the neck 10 and then turned, for example in a clock-wise direction, to engage the thread sections 13 beneath the thread sections 12.

Each of the thread sections 12 on the neck 10 is illustrated as having an upwardly inclined tang 18 which functions to guide the leading end of any one of the cap thread sections 13 when the cap 11 is thrust downwardly onto the neck 10 and then rotated.

In the illustrated embodiment of the invention, each of the thread sections 12 on the neck 10 has a series of ratchet teeth 19 on its under surface and each of the thread sections 13 on the cap 11 has a cooperating and opposed series of ratchet teeth 20 on its upper surface. While the ratchet teeth 19 and 20 are shown as being molded integrally in the respective under and upper surfaces of the thread sections 12 and 13, such ratchet teeth might be molded on the surfaces of the container neck 10 and the cap skirt 14 adjacent the thread sections 12 and 13 rather than being integral with them.

Figure 3:
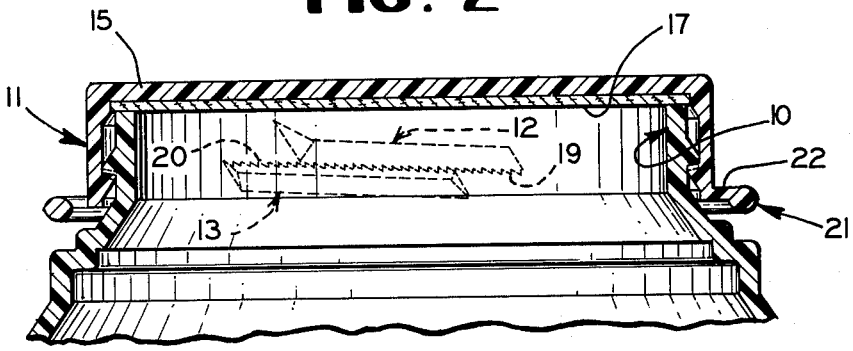
FIG. 3 is a fragmentary vertical sectional view similar to FIG. 1 but showing both the container neck and cap in transverse vertical section and with the two engaged in closed position.

As can best be seen in FIG. 3, when the cap 11 is thrust downwardly and then rotated in a clock-wise direction relative to the neck 10, the ratchet teeth 19 and 20 of the threads 12 and 13 engage each other and the cap 11 is rotated to a degree sufficient to insure that the liner 17 is tightly pressed against the upper open end of the container neck 10. In initial capping at a plant in which the containers are filled with the content material, the degree of rotation of the cap 11 relative to the container neck 10 usually is controlled by a torque-responsive capping chuck. It will also be observed in FIG. 3 that the extent of the engagement of the opposed cooperating sets of ratchet teeth 19 and 20 usually would be planned to be such that the teeth continuously would be engaged even if the cap 11 were turned onto the neck 10 farther than the illustrated position shown in FIG. 3, for example, by cumulated manufacturing tolerances, by gradual depression of the portions of the liner 17 engaging the end of the container neck 10, etc.

When the cap 11 has been turned onto the container neck 10 as illustrated in FIG. 3, the engagement of the cooperating opposed ratchet teeth 19 and 20 prevents the cap 11 from being rotated in a retrograde direction (usually counter-clockwise) and the closure combination retains the container sealed against opening.

Figure 2:
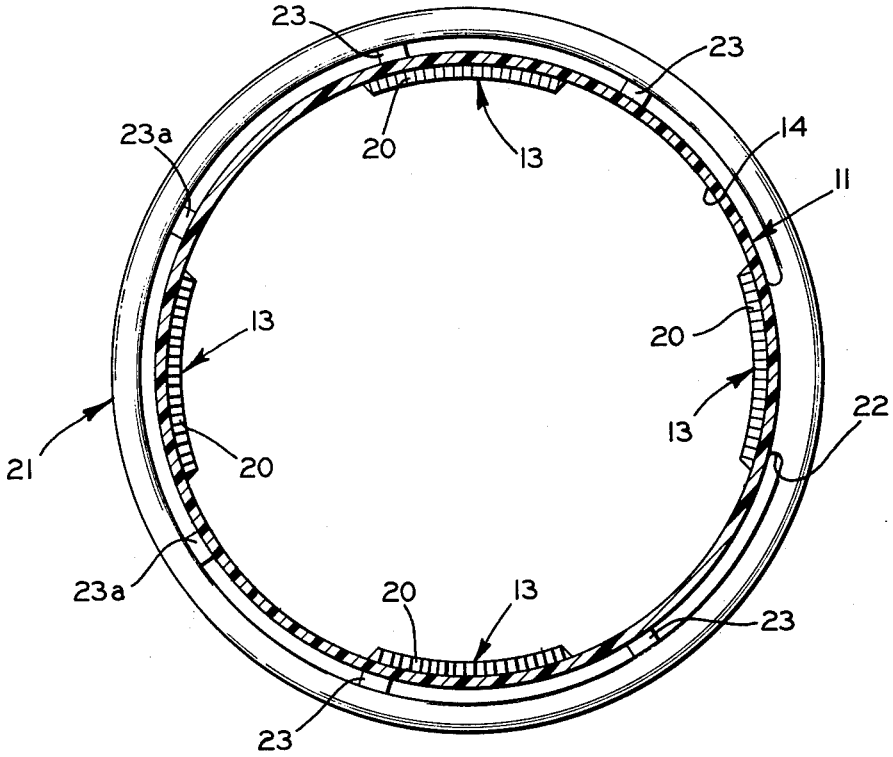
FIG. 2 is a horizontal sectional view taken along the line 2—2 of FIG. 1.

According to the invention, however, the cap 11 of the closure combination has a puller by means of which the cap 11 may be removed from the container neck by disengagement of the ratchet teeth 19 and 20. In the illustrated embodiment, the puller consists of a ring 21 which is molded integrally with the cap 11 and circumscribes the cap skirt 14. The ring 21 is connected to the lower margin of the cap skirt 14 by a relatively thick and wide non-frangible web 22 at one side of the cap 11 and by at least one or a plurality of relatively thin and narrow frangible webs 23 which are spaced from each other around the periphery of the cap skirt 14. Preferably, none of the frangible webs 23 is located in diametric opposition to the non-frangible web 22 in order to provide for some flexibility of the ring 21 between the frangible webs 23 which are spaced on opposite sides of a diameter bisecting the non-frangible web 22, such spaced webs being indicated by the reference No. 23*a* in FIG. 2.

As long as the puller ring 21 remains in its original position (FIG. 3), it is a clear indication that the container closed by the combination of the invention has not been opened, i.e., it is tamper-proof in the sense that if opened or tampered with, that fact will be indicated.

Figure 4:
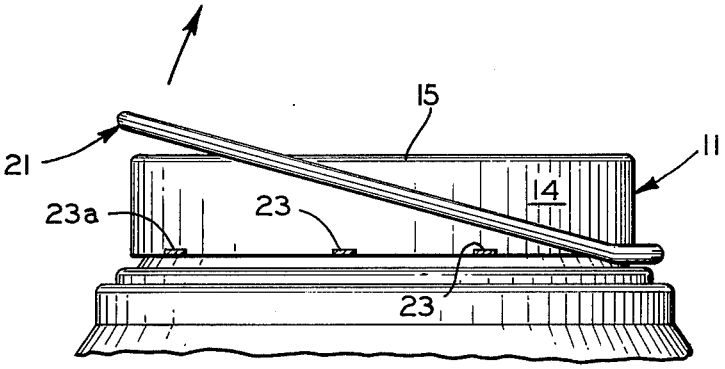
FIG. 4 is a fragmentary view in side elevation showing a closure combination according to the invention when the puller initially is disconnected from its frangible or detachable retaining means.
Figure 5:
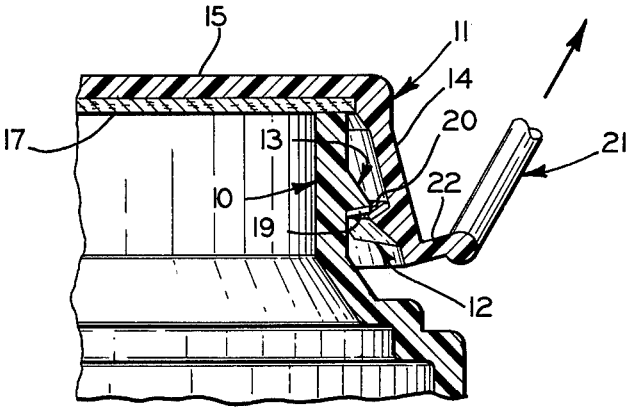
FIG. 5 is a fragmentary vertical sectional view on a greatly enlarged scale showing how the puller is utilized for disengaging the means retaining the cap on the container neck.
Figure 6:
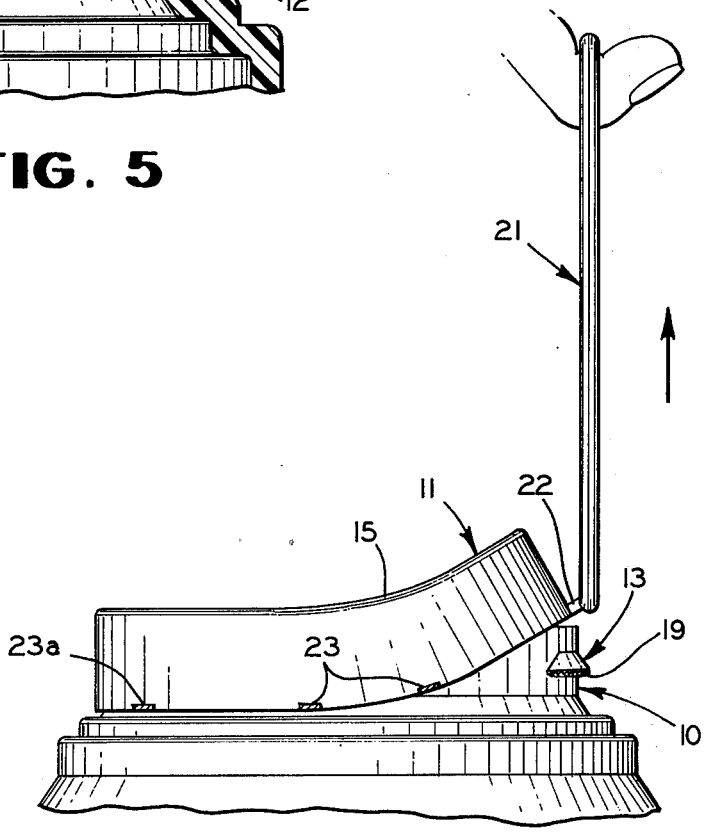
FIG. 6 is a view similar to FIG. 4 but showing how the puller is utilized for peeling the cap off of the container neck.

When a person wishes to open the container to gain access to the material therein, he grasps the puller ring 21 and lifts upwardly as indicated by the arrow in FIG. 4, first breaking the frangible webs 23*a* and sequentially the remainder of the frangible webs 23 until the puller ring has been swung over to the position fragmentarily illustrated in FIG. 5. Continued upward and outward pulling of the ring 21 first stretches the cap skirt 14 outwardly to disengage the sets of ratchet teeth 19 and 20 radially adjacent the non-frangible web 22. Continued pulling force exerted on the ring 21, as illustrated in FIG. 6, then gradually strips or peels the cooperating opposed ratchet teeth 19 and 20 from each other progressively along their lengths so that the cap 11 is removed from the container neck 10.

After the user has removed from the container that quantity of the content material desired, the cap 11 can readily be restored into closed position on the container neck 10 by again thrusting it downwardly and rotating it in a proper direction (usually clock-wise) to re-engage the two sets of cooperating threads 12 and 13 and their respective ratchet teeth 19 and 20 to reseal the container. However, because the puller 21 has been removed from its initial position, that fact is a clear indication that the container has been opened.

The tamper-indicating feature of a closure combination according to the invention has several desirable results. First, it prevents a dishonest person from removing the cap of an expensive item and replacing it with the cap bearing a smaller or lesser price. Second, it prevents a curious person from opening the container to sample its contents. Unfortunately, such events frequently occur in hidden portions of large supermarkets, for examples, where a customer wishes to determine the particular taste or flavor of a substance such as peanut butter, jam, etc., many of which products are packaged for retail sale in wide mouthed containers. Third, it is a clear indication to persons working in the food preparation portion of an institution such as a hospital or restaurant that this particular container of materials has previously been opened and, therefore, the remainder of its contents should be utilized in the food preparation activities prior to the utilization of similar materials in other unopened containers.

A further advantage of a closure combination according to the invention is that by proper selection of the stiffness of the cap skirt 14, the thickness or toughness of the frangible webs 23 and 23*a* and the thickness and strength of the non-frangible web 22, the closure can be rendered child-resistant so that a small child, say of the order of six years of age or less, would find it impossible to exert sufficient force to tear away the puller from its initial position. Conversely, of course, the thickness, strength, flexibility, etc. can be so selected as to enable the container to be opened as desired by an older child or an adult.

A closure combination according to the invention is thus both tamper-indicating and child-resistant and is capable of ready resealing and re-opening when desired.

Having described my invention, I claim:

1. A tamper-indicating closure combination for a container having a neck, said combination comprising a. an inverted generally cup-shaped cap having a flexible skirt that is adapted to fit over said container neck and close the same, b. cooperating threads on the inner side of said cap skirt and the exterior of said container neck, c. said cap and container neck having opposed cooperating ratchet teeth on adjacent surfaces which are engaged when said cap is rotated onto said neck thereby preventing retrograde rotation of said cap relative to said neck without disengagement of said cooperating ratchet teeth, and d. a manually graspable puller permanently connected to said cap at one side thereof for pulling said cap skirt upwardly and outwardly for flexing said cap skirt in order to disengage said cooperating ratchet teeth and thereby to remove said cap.

2. A closure combination according to claim 1 which at least one of said opposed ratchet teeth consists of a circumferentially extending multiplicity of individual teeth.

3. A closure combination according to claim 1 in which the threads on the container neck and on the cap skirt are interrupted and in which each segmental section thereof extends circumferentially a number of degrees that is less than 360/2X, in which X is the number of individual interrupted thread sections on each of said neck and skirt.

4. A closure combination according to claim 2 in which both of said opposed ratchet teeth consist of circumferentially extending series of individual teeth.

5. A closure combination according to claim 1 in which the ratchet teeth are located on the under surface of the thread on the container neck and extend radially outwardly relative to the axis of said container neck and the ratchet teeth on the cap skirt are complementary to those on said container neck.

6. A closure combination according to claim 1 in which the puller is detachably connected to said cap at a point removed from the place of permanent connection of said puller to said cap.

7. A closure combination according to claim 6 in which the puller is integral with the cap.

8. A closure combination according to claim 1 in which the puller is a ring that initially is unitary with the cap, and that is connected thereto by a non-frangible web at one side of said cap and by at least one frangible web at a point spaced around the periphery of said cap from said first web.

9. A closure combination according to claim 8 in which the puller is a ring that initially circumscribes the cap and is connected to said cap at the margin of the cap skirt.

10. A closure combination according to claim 8 in which there are a plurality of frangible webs connecting the ring to the skirt at points spaced around the periphery of said ring and none of said frangible webs is located at a point diametrically opposite the non-frangible web.

11. A closure combination according to claim 8 in which the cross section of the frangible webs is sufficiently heavy to prevent their being broken by such force as can be applied to the puller by an average child of tender years but capable of being broken by such force as can be applied thereto by an average older child or adult.

12. A tamper-indicating, replaceable cap for a container having a circular neck and a plurality of interrupted thread sections on the exterior of said neck, each of said thread sections having ratchet-like teeth on its under surface, said cap having a. a disc-like closed top, b. an annular skirt depending from said top, c. a plurality of interrupted thread sections on the inner surface of said skirt equal in number to those sections on said container neck and positioned and arranged to mate with the thread sections on said container neck, d. ratchet teeth on the upper surfaces of said thread sections on said cap skirt that are opposed to and inter-engageable with the ratchet teeth on said thread sections on said container neck, and e. a puller that initially is unitary with said cap and that is connected thereto by frangible elements at points around the periphery of said cap and by a non-frangible element at one side of said cap, whereby when said cap is turned onto said container neck, said sets of ratchet teeth interengage and prevent retrograde rotation of said cap relative to said container neck and said puller then can be broken away and utilized to pull said cap skirt upwardly and outwardly at the side where said non-frangible element connects said puller and said cap for disengaging said sets of ratchet teeth and removal of said cap from said container neck.

13. A cap according to claim 12 in which the puller is a ring that initially circumscribes the cap body.

14. A cap according to claim 12 in which the non-frangible connecting element extends between the puller and the margin of the cap skirt.

* * * * *